US005899354A

United States Patent [19]

Garcia

[11] Patent Number: 5,899,354

[45] Date of Patent: May 4, 1999

[54] DRINKING MUG

[76] Inventor: Miguel Z. Garcia, 22723 Elsinore Dr., Katy, Tex. 77450-1642

[21] Appl. No.: 08/976,473

[22] Filed: Nov. 12, 1997

[51] Int. Cl.[6] ..... B65D 17/44

[52] U.S. Cl. ..... 220/669; 220/703; 220/914; 220/DIG. 13; 206/217; 206/822

[58] Field of Search ..... 220/707, 710.5, 220/669, 674, 914, DIG. 13; 206/217, 822

[56] References Cited

U.S. PATENT DOCUMENTS

| | | | |
|---|---|---|---|
| D. 168,784 | 2/1953 | Del Mas . | |
| 2,069,089 | 1/1937 | Goldman . | |
| 2,627,735 | 2/1953 | Dexter | 220/703 |
| 2,652,701 | 9/1953 | Longhurst . | |
| 2,671,326 | 3/1954 | Pickering . | |
| 4,210,141 | 7/1980 | Brockman | 128/272 |
| 4,235,348 | 11/1980 | Watson | 220/90.4 |
| 4,609,113 | 9/1986 | Seki | 215/1 R |
| 4,762,229 | 8/1988 | Wickre | 220/703 |
| 5,169,026 | 12/1992 | Patterson | 220/703 |
| 5,323,928 | 6/1994 | Stevens | 220/703 |
| 5,749,491 | 5/1998 | Wylder et al. | 220/703 |

FOREIGN PATENT DOCUMENTS 70031 11/1948 Norway .

*Primary Examiner*—Joseph M. Moy
*Attorney, Agent, or Firm*—Harrison & Egbert

[57] ABSTRACT

A drinking mug including a body having a lipid-receiving interior volume with a handle connected to the body and extending outwardly therefrom. The body has a first eye relief channel extending longitudinally along the body and a second eye relief channel extending generally parallel to the first eye relief channel and extending longitudinally along the body. The first and second eye relief channels are indentations in the exterior surface of the annular configuration of the body. Each of the first and second eye relief channels extends from a top of the body to a bottom of the body. A nose bridge receptacle is formed in the body between the first and second eye relief channels.

17 Claims, 2 Drawing Sheets

FIG. 1
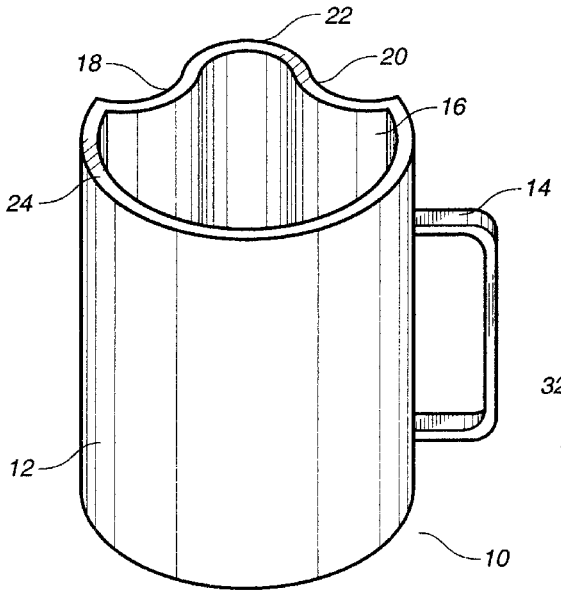
FIG. 2
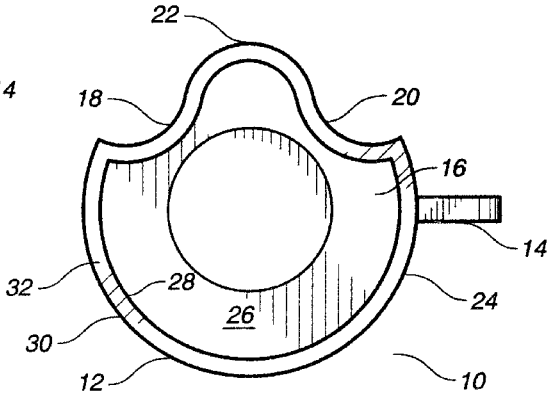
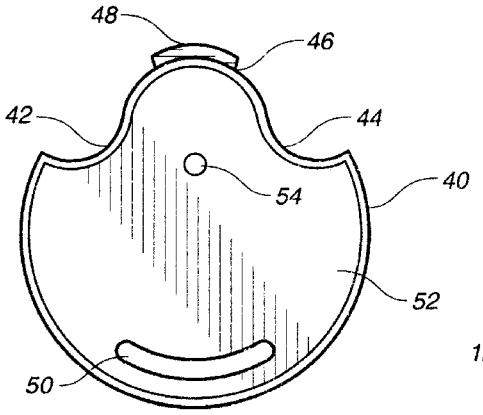
FIG. 3
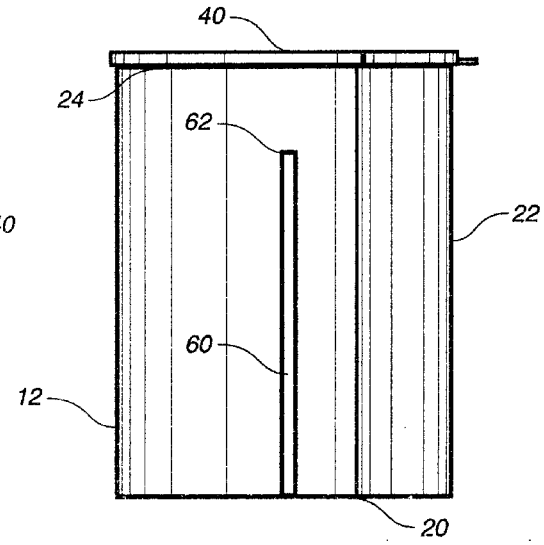
FIG. 4

FIG. 5
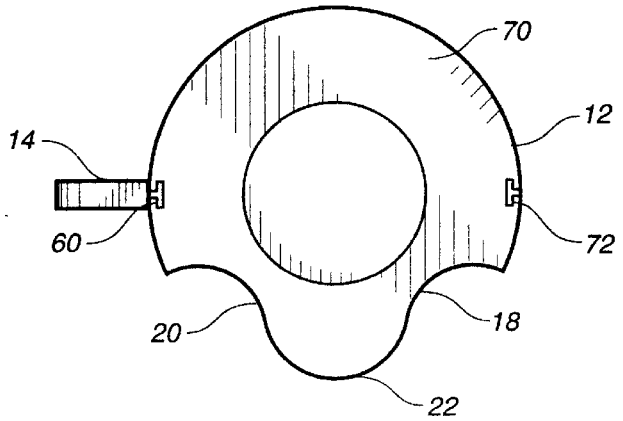
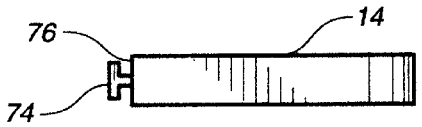
FIG. 6
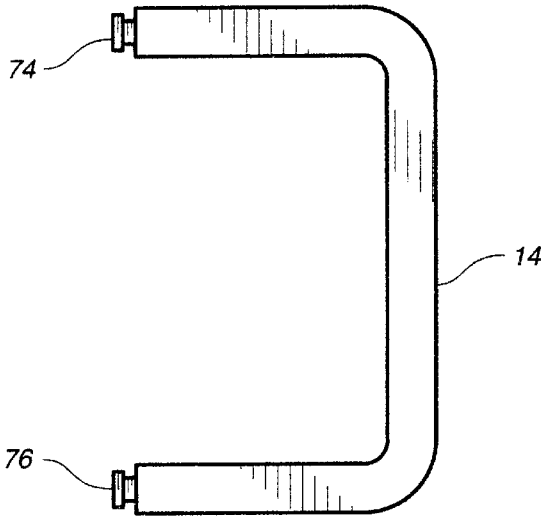
FIG. 7

DRINKING MUG

TECHNICAL FIELD

The present invention relates to drinking mugs. More particularly, the present invention relates to drinking mugs which improve the ability to see the person drinking from the mug.

BACKGROUND ART

In order to drink a beverage or the like from a conventional cup, mug, tumbler or the like (hereinafter generally called "mug" for the sake of brevity), it is necessary to hold up the bottom of the cup, from which the user has been drinking the beverage while maintaining the cup in a forward-and-downward directed position such that the rear side of the cup is turned counterclockwise beyond the horizontal level into a forward-and-upward directed position. When the bottom of the mug is raised while keeping the user's mouth in contact with a rear portion of the upper edge of the mug, a front portion of the upper edge is eventually brought into contact with the nose ridge of the users hen the mug is brought into contact with the nose ridge of the user, the periphery of the mug will generally block the view of the user. The blocking of the view of the user's eyes can become disconcerting during conversation. The blocking of the user's eyes can potentially be hazardous during the driving of a motor vehicle. There are various other circumstances in which the person drinking from the mug will not want to have his or her eyes blocked by the periphery of the mug.

In the past various patents have issued relating to various drinking apparatus which accommodate the nose of the user. For example, U.S. Pat. No. 4,609,113, issued on Sep. 2, 1986 to N. Seki discloses a cup that permits the easy drinking of the liquid contents. The cylindrical side wall of the cup is composed of a thin-walled material having suitable degrees of flexibility and elasticity. There are a number of bellows-like corrugations that are provided in the cylindrical side wall in such a way that the corrugations extend substantially parallel with the bottom wall of the cup The corrugations are allowed to undergo collapse when the upper edge of the cup is brought into contact with the nose ridge of the user.

U.S. Pat. No. 5,323,928, issued on Jun. 28, 1994 to B. A. Stevens describes a dysphagia cup. This cup serves to assist swallowing by having a hollow container portion with a base and an upwardly extending, elliptically-shaped side wall. The eliptical aperture is sized to accommodate a person's nasal bridge during drinking such that substantial backwards angulation of the head is not required.

U.S. Pat. No. 4,235,348, issued on Nov. 25, 1980 to L. E. Watson describes a drinking vessel for use while in a reclined position. This drinking vessel includes a spout that has a contoured lip with specially curved liquid-spill resistant side walls so as to facilitate improved spill resistance when the cup is brought to the user a lips.

U.S. Pat. No. 4,210,141, issued on Jul. 11, 1980 to R. G. Brockamn teaches a hiccough treatment appliance which includes a drinking vessel with a tongue-depressor portion adjacent the drinking portion for projecting into the mouth of the person drinking liquid from the appliance so as to depress the person's tongue while the liquid is being swallowed U.S. Pat. No. 2,069,089, issued on Jan. 26, 1937 and U.S. Design Pat. No. 168,784, issued on Feb. 10, 1953 teach feeding cups with outwardly extending lips for accommodating the mouth and nose bridge of the user.

U.S. Pat. No. 2,671,326, issued on Mar. 9, 1954 to T. E. Pickering describes a drinking vessel with a mouth at its upper end offset laterally with respect to the bottom of the vessel. The drinking vessel facilitates the drinking from the vessel when it is difficult for a child to bend his or her head backwards.

It is an object of the present invention to provide a drinking mug which allows the user to see outwardly while drinking from the mug.

It is another object of the present invention to provide a drinking mug which allows the mug to be rotated fully against the nose bridge of the user during drinking activity.

It is a further object of the present invention to provide a drinking mug which is adaptable to left-handed or right-handed usage.

It another object of the present invention to provide a drinking mug which facilitates safety during the drinking activities.

It is still a further object of the present invention to provide a drinking mug which is easy to manufacture, easy to use and relatively inexpensive.

These and other objects and advantages of the present invention will become apparent from a reading of the attached specification and appended claims.

SUMMARY OF THE INVENTION

The present invention is a drinking mug which comprises a body having a liquid-receiving interior volume and a handle connected to the body and extending outwardly therefrom. The body has a first eye relief channel extending longitudinally along the body and a second eye relief channel extending generally parallel to the first eye relief channel and extending longitudinally along the body. The body has a generally annular cross-sectional configuration in a horizontal planes The first eye relief channel is an indentation in the exterior surface of the annular configuration. The second eye relief channel is another indentation at an exterior surface of the annular configuration. Each of the first and second eye relief channels extends from a top of the body to a bottom of the body. The first eye relief channel has a longitudinal axis in spaced parallel relationship to a longitudinal axis of the second eye relief channel.

In the present invention, a nose bridge receptacle is formed in the body between the first and second eye relief channels The nose bridle receptacle extends outwardly of the first and second eye relief channels. The nose bridge receptacle has a longitudinal axis in parallel relationship to the longitudinal axes of the first and second eye relief channels. The of the first and second eye relief channels have a curved shape in a cross-section in a horizontal planes The first eye relief channel is spaced from the second eye relief channel by a distance generally corresponding to a distance between human eyes.

The body has a first slot extending vertically along one side of the body. The first slot detachably receives the handle therein. The body has a second slot extending vertically along an opposite side of the body. The second slot is suitable for detachably receiving the handle therein The second slot is positioned at a location 180° from the first slot. The first slot is positioned on the body to one side of the first eye relief channel. The second slot is positioned on the body to a side of the second eye relief channel.

The body has an interior liner surrounding the liquid-receiving volume. The body has an exterior surface spaced from the interior liner. A foam insulation is interposed in the space between the interior liner and the exterior surface.

A lid is detachably affixed over a top of the body. This lid extends around the first and second eye relief channels at the top of the body. The lid has a shape conforming to the eye relief channels. A tab is formed on an edge of the lid so as to extend outwardly from the lid. This tab is positioned between the first and second eye relief channels. The lid has a drinking slot foxed therein so as to open to the interior volume. A vent is foxed in the lid so as to open to the interior volume.

BRIEF DESCRIPTION OF THE DRAWINGS

FIG. 1 is a perspective view of the drinking mug of the present invention.

FIG. 2 is a plan view of the drinking mug of the present invention.

FIG. 3 is a isolated view of the lid used on the drinking mug of the present invention.

FIG. 4 is a side elevational view of the drinking mug of the present invention.

FIG. 5 is a bottom view of the drinking mug of the present invention.

FIG. 6 is an isolated plan view of the handle used on the drinking mug of the present invention.

FIG. 7 is an isolated side view of the handle used on the drinking mug of the present invention.

DETAILED DESCRIPTION OF THE INVENTION

Referring to FIG. 1 there is shown at 10 the drinking mug of the present invention. The drinking mug 10 includes a body 12 and a handle 14. The body 12 has a lipid-receiving interior volume 16. The body 12 has a first eye relief channel 18 extending longitudinally along the body and a second eye relief channel 20 also extending longitudinally along the body 12. The first eye relief channel 18 extends in parallel relationship to the second eye relief channel 20. A mass bridge receptacle 22 is formed in the area between the first eye relief channel 18 and the second eye relief channel 20. The handle 14 is connected to the body 12 and extends outwardly therefrom.

The body 12 generally has the appearance of a conventional drinking mug. However, so as to accommodate the eyes of the user, the first eye relief channel 18 and the second eye relief channel 20 are formed along the body 12. The nose bridge receptacle 22 is located between the eye relief channels so as to allow the user to fully rotate the drinking mug 10 to its desired position against the nose bridge of the user. The combination of the first aye relief channel 18, the nose bridge receptacle 22 and the second eye relief channel 20 take on a somewhat waveform configuration along the rim 24 of the body 12. The first eye relief channel 18 should be spaced from the second eye relief channel 20 so as to generally match the distance between human eyes. The first aye relief channel 18 has a radius which generally matches the radius of the second eye relief channel 20. The first aye relies channel 18 and the second eye relief channel 20 are indentations along the generally annular cross-sectional configuration of the body 12. The radial axis of the first eye relief channel 18 will be in parallel relationship to the radial axis of the second eye relief channel 20. The nose bridge receptacle 22 will also have a radial axis which is in parallel relationship to the axis of the first aye relief channel 18 and the second eye relief channel 20.

The handle 14 has a generally C-shaped configuration. As can be seem,, the handle 14 is attached to the right side of the drinking mug 10. As such, drinking mug 10 cam be properly used by a right-handed person. However, if the user is left-handed, then the handle 14 will be in am improper location for the user to properly use the eye relief channels. As such, as will be described hereinafter, the handle 14 is detachable so as to be located on the other side of the body 12 180° from the location as illustrated in FIG. 1.

FIG. 2 shows the drinking mug 10 of the present invention as seen from above. The drinking mug 10 has a top rim 24 and an interior volume 16. The first eye relief channel 18 and the second eye relief channel 20 extend from the top of the body 12 to the bottom 26 of the body 12. The nose bridge receptacle 22 is illustrated as extending from the top to the bottom of the drinking mug 10. Each of the eye relief channels 18 and 20 is curved in a horizontal plane and inward of the diameter of body 12.

In the present invention, the drinking mug 10 includes an interior liner 28 and an exterior surface 30. A space 32 is located between the interior liner 28 and the exterior surface 30. Space 32 cam be filled with a foam insulation material so as to improve the insulating qualities on the interior 16 of the drinking mug 10. Alteratively, the space 32 can simply be air insulation. Handle 14 is illustrated as affixed to the exterior surface 30 of the body 12.

FIG. 3 shows a lid 40 which is suitable for being affixed around the rim 24 of the body 12. The lid 40 includes areas 42 and 44 for conforming to the first eye relief channel 18 and the second eye relief channel 20, respectively. An area 46 is formed in the lid 40 so as to conform to the nose bridge receptacle 22. A tab 48 extends outwardly of the lid 40 between the areas 42 and 44. The tab 48 extends outwardly of the portion of the lid placed on the nose bridge receptacle 22. A drinking slot 50 is formed in the surface 52 of the lid 40 so as to open to the interior volume 16 of the body 12. A vent 54 is also formed in the surface 52 of lid 40 so as to open to the interior volume 16. The surface 52 should be indented downwardly relative to the top surface of the lid 40. If surface 52 is at a lower level than the top surface of the rim 40, them a space will be provided such that the user's nose can enter the space so as to allow the nose bridge receptacle 22 and its associated portion 46 from the lid 40 to contact the bridge of the moss of the user.

FIG. 4 shows a side view of the body 12. As cam be seen, a slot 60 extends longitudinally along the side of the body 12. Slot 60 is suitable for the detachable receipt of handle 14 therein. The eye relief channel 20 is illustrated extending inwardly of the nose bridge receptacle 22. Lid 40 is illustrated as placed over the rim 24 of the body 12. It can be seen in FIG. 4 that the second eye relief channel 20 extends from the top to the bottom of the body 12 The slot 60 will extend for less than the entire length of the body 12. End 62 of slot 60 serves as a stop to the sliding movement of the handle 14 within the slot 60.

Importantly, the body 12 will have a similar configuration on the opposite side. As such, another slot, such as 60, will appear on the opposite side so as to allow the handle 14 to be interchangably positioned on one side of the body 12 and the other side of the body 12.

FIG. 5 shows a view of the bottom 70 of the body 12. As can be seen, a slot 60 is formed in the side of the body 12. Another slot 72 is formed 180° from the first slot 60. Slot 72 is formed inwardly of the side of the body 12. Slot 60 is shown as receiving the handle 14 therein. Slot 72 would also be suitable for receiving the handle 14 therein FIG. 6 is an isolated view of the handle 14 As can be seen, the handle 14 includes a slide member 74 formed on an end 76 of handle 14. Slide member 74 is suitable for insertion into the slot 60 and/or slot 72. As such, the handle 14 can be attached to the body 12 of the drinking mug 10.

FIG. 7 shows an isolated view of the handle 14. It can be seen that there is a slide member 74 located at the top of the handle 14 and another slide member 78 located at the bottom of the handle 14. The insertion of the slide member 74 and 78 into either of the slots 60 and/or 72 will allow the handle 14 to be securely attached to the side of the body 12. As such, the handle can be adapted for left hand and/or right hand usage of the drinking mug 10.

The present invention provides a drinking mug which can be easily used by a person during conversation and/or driving activities. Whenever it is desired to drink from the mug 10, the handle 14 is suitably rotated so that liquid flows from the interior volume 16 into the mouth of the user. Eventually, in order to consume the entire volume of liquid within the interior volume 16, the handle 14 will be rotated such that the nose bridge receptacle 22 will reside against the bridge of the nose of the user. In such a circumstance, the user will still be able to clearly view outwardly of the drinking mug 10 by virtue of the eye relief channels 18 and 20. Normal conversation can be carried out without blocking the eyes of the person using the mug. The specially designed lid 40 allows for a "spill proof" form of the drinking mug 10. The handle 14 can be adapted to left hand and/or right hand usage for the convenience of the user.

The foregoing disclosure and description of the invention is illustrative and explanatory thereof. Various changes in the details of the illustrated construction may be made within the scope of the appended claims without departing from the true spirit of the invention. The present invention should only be limited by the following claims and their legal equivalents

I claim:

1. A drinking mug comprising:

a body having a liquid-receiving interior volume, said body having a first eye relief channel extending longitudinally along said body and a second eye relief channel extending generally parallel to said first eye relief channel and extending longitudinally along said body, each of said first and second eve relief channels having a curved shape in a cross-section parallel to a bottom of said body, each of said first and second eye relief channels having a radius extending from a point exterior of said body, said body having a side extending transverse to said bottom of said body; and a handle connected to said body and extending outwardly therefrom.

2. The mug of claim 1, said body having a generally annular cross-sectional configuration in a horizontal plane.

3. A drinking mug comprising:

a body having a liquid-receiving interior volume, said body having a first eye relief channel extending longitudinally along said body and a second eye relief channel extending generally parallel to said first eye relief channel and extending longitudinally along said body. said body having a generally annular configuration in a plane parallel to a bottom of said body, said first eye relief channel being a curved indentation in an exterior surface of said annular configuration, said second eye relief channel being another curved indentation in said exterior surface of said annular configuration; and a handle connected to said body and extending outwardly therefrom.

4. The mug of claim 3, each of said first and second eye relief channels extending from a top of said body to a bottom of said body.

5. The mug of claim 4, said first eye relief channel having a longitudinal axis in spaced parallel relationship to a longitudinal axis of said second eye relief channel.

6. The mug of claim 1, further comprising:

a nose bridge receptacle formed in said body between said first and second eye relief channels, said nose bridge receptacle extending outwardly of said first and second eye relief channels.

7. The mug of claim 6, said nose bridge receptacle having a longitudinal axis in parallel relationship to a longitudinal axis of said first eye relief channel and to a longitudinal axis of said second eye relief channel.

8. The mug of claim 1, said first eye relief channel being spaced from said second eye relief channel by a distance generally corresponding to a distance between human eyes.

9. A drinking mug comprising:

a body having a liquid-receiving interior volume, said body having a first eye relief channel extending longitudinally along said body and a second eye relief channel extending generally parallel to said first eye relief channel and extending longitudinally along said body, and a handle connected to said body and extending outwardly therefrom, said body having a first slot extending vertically along one side of said body, said first slot detachably receiving said handle therein, said body having a second slot extending vertically along an opposite side of said body, said second slot suitable for detachably receiving said handle therein said second slot being positioned at a location 180° from said first slot.

10. The mug of claim 9, said first slot positioned on said body to one of said first eye relief channel, said second slot positioned on said body to a side of said second eye relief channel.

11. The mug of claim 1, said body having an interior liner surrounding said fluid-receiving volume, said body having an exterior surface spaced from said interior liner.

12. The mug of claim 11, said body having foam insulation interposed in the space between said interior liner and said exterior surface.

13. The mug of claim 1, further comprising:

a lid detachably affixed over a top of said body.

14. The mug of claim 13, said lid extending around said first and second eye relief channels at said top of said body, said lid having a shape conforming to said first and second eye relief channels.

15. The mug of claim 14, said lid having a tab formed on an edge thereof, said tab extending outwardly from said lid, said tab positioned between said first and second eye relief channels.

16. The mug of claim 14, said lid having a drinking slot formed therein, said drinking slot opening to said interior volume.

17. The mug of claim 16, said lid having a vent formed therein, said vent opening to said interior volume.

* * * * *